US005522735A

United States Patent [19]

Wright

[11] Patent Number: 5,522,735

[45] Date of Patent: Jun. 4, 1996

[54] CONDUCTOR CLAMP

[76] Inventor: John O. Wright, 2710 St. Andrews Way, York, Pa. 17404

[21] Appl. No.: 510,083

[22] Filed: Aug. 1, 1995

[51] Int. Cl.[6] ..... H01R 13/66

[52] U.S. Cl. ..... 439/540.1; 439/468

[58] Field of Search ..... 439/540.1, 468, 439/374, 449, 451, 355, 445, 471, 142, 483

[56] References Cited

U.S. PATENT DOCUMENTS 2,420,103 8/1941 Smith ..... 439/142
3,452,321 4/1967 Carissimi et al. ..... 439/483
3,622,942 11/1971 Rynk ..... 439/471

*Primary Examiner*—P. Austin Bradley
*Assistant Examiner*—Eugene G. Byrd
*Attorney, Agent, or Firm*—William H. McNeill

[57] ABSTRACT

A clamp is provided which is removably attachable relative to a connector and/or a conductor connected thereto. The clamp includes a plurality of ribs which extend in the direction of an axis of the clamp and protrude radially relative to such axis. Attachment of a respective clamp to adjacent connectors and/or conductors connected thereto such that ribs of one clamp mate or mesh with ribs of the other clamp is useful in controlling the angular disposition between the adjacent connectors and conductors connected thereto.

10 Claims, 1 Drawing Sheet

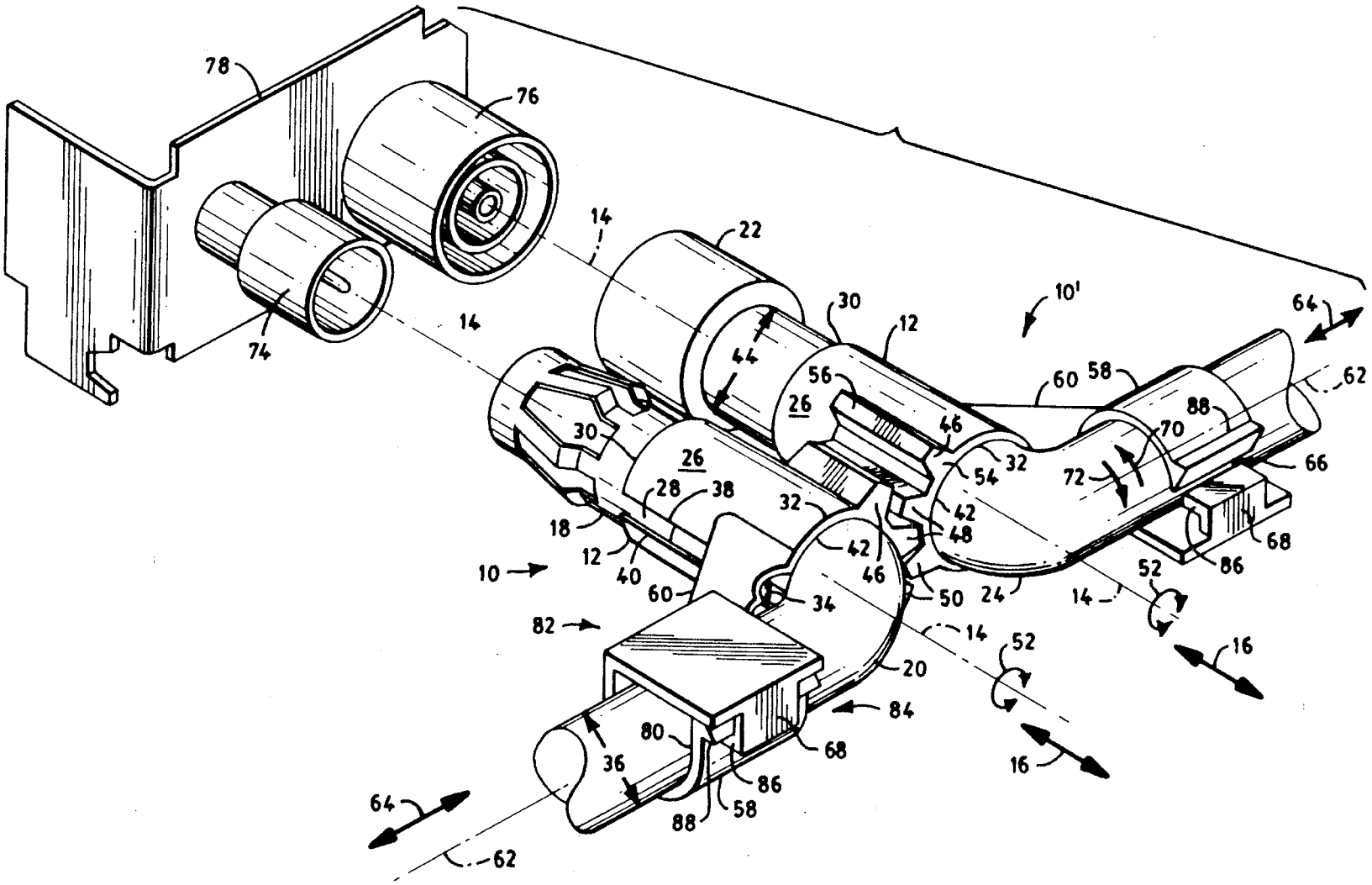
10'
10
12
14
16
18
20
22
24
26
28
30
32
34
36
38
40
42
44
46
48
50
52
54
56
58
60
62
64
66
68
70
72
74
76
78
80
82
84
86
88

CONDUCTOR CLAMP

BACKGROUND OF THE INVENTION

1. Field of the Invention

The present invention relates to a clamp and to a connector assembly which includes such clamp. More particularly, the present invention relates to a clamp and to a connector assembly which includes such clamp for use with antenna connectors.

2. Description of Prior Art

A typical connector such as an antenna connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. It is not unusual for a mating pair of such male and female connectors to be mounted immediately adjacent another mating pair of such connectors. In such applications, undesirable rotation of adjacent pairs of connectors and coaxial cables connected thereto occurs.

DISCLOSURE OF THE INVENTION

It is an object of the present invention to provide a clamp for use in preventing rotation of a connector and conductor connected thereto relative to an adjacent connector and conductor connected thereto.

It is another object of the present invention to provide such a clamp wherein the angular orientation of such a connector and conductor may be fixed relative to the angular orientation of such an adjacent connector and conductor.

It is a further object of the present invention to provide such a clamp wherein the angular orientation of such a connector and conductor may be selectively varied relative to the angular orientation of such an adjacent connector and conductor.

It is yet another object of the present invention to provide a connector assembly which includes such a clamp.

This invention achieves these and other objects by providing a clamp which comprises a first clamp member removably attachable relative to a connector and/or a conductor which is connected to the connector. The first clamp member has a first axis which extends in a first direction. The first clamp member includes an outer surface having a plurality of ribs extending therefrom. In a preferred embodiment, the clamp also comprises a second clamp member attached to the first clamp member. The second clamp member has a second axis which extends in a second direction. The second axis is oriented at an angle relative to the first axis. The second clamp member is removably attachable relative to the conductor. A connector assembly which comprises a mating pair of first clamp members is also provided for herein.

BRIEF DESCRIPTION OF THE DRAWINGS

The single FIGURE is perspective view of a connector assembly and clamps embodying the present invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

The embodiment of this invention which is illustrated in the drawing is particularly suited for achieving the objects of this invention. The drawing depicts two clamps 10, 10' of the present invention. Clamps 10, 10' are identical in construction, and therefore like reference numerals of each clamp represent like elements. Each clamp 10, 10' comprises a first clamp member 12 which has an axis 14 which extends in a first direction 16. The first clamp member 12 of clamp 10 is attached to a connector 18 and a conductor 20 which is a coaxial cable electrically and mechanically connected to connector 18 in a conventional manner. In the embodiment of FIG. 1, connector 18 is a conventional female connector which mates with a male connector in the usual manner. Similarly, the first clamp member 12 of clamp 10' is attached to a connector 22 and a conductor 24 which is a coaxial cable electrically and mechanically connected to connector 22 in a conventional manner. In the embodiment depicted in the drawing, connector 22 is a conventional male connector which mates with a female connector in the usual manner. In the embodiment depicted in the drawing, the axis 16 of each first clamp member 12 is also the axis of the connector and the length of the conductor attached to the first clamp member. It will be apparent to those skilled in the art that connectors 18 and 22 do not have to be female and male connectors, respectively, but rather may be either kind of connector. Similarly, the use of coaxial cables is by way of example only.

Respective first clamp members 12 are removably attachable to conductors 20 and 24. For example, in the embodiment depicted in the drawing, each first clamp member 12 comprises a resilient material and has an outer surface 26 which comprises an opening 28 (only visible in first clamp member 12 of clamp 10) which extends in the direction 16 for the length of the first clamp member; that is, from end 30 to opposite end 32. Outer surface 26 has a generally cylindrical configuration, and the opening 28 has a width 34 which is less than the diameter of each conductor, such as the diameter 36 of conductor 20. The first clamp members 12 may be attached to respective conductors 20, 24 by placing a length of a conductor adjacent an opening 28 and squeezing the conductor against the first clamp member causing edges 38, 40 of the opening 28 to move apart due to the resiliency of the first clamp members 12, allowing the conductor to snap into the cavity 42 of the sleeve-like first clamp member. It will be apparent to those skilled in the art that the width 34 of opening 28 is also less than the diameter of each connector such as the diameter 44 of connector 22 and that the first clamp member 12 may also be attached to a respective connector as depicted in the drawing by placing a length of a connector adjacent an opening 28 and squeezing in the same manner as described with respect to conductors 20, 24. The first clamp member 12 may be moved in the direction 16 of axis 14 so that the first clamp member may be positioned so that it may be attached to a connector, a conductor, or to a connector and a conductor as depicted in the drawing.

Each first clamp member 12 comprises a plurality of ribs which extend from an outer surface 26. For example, in the embodiment depicted in the drawing each clamp member comprises ribs 46, 48, 50 each of which protrudes from outer surface 26 and extends in the direction 16 of axis 14. Adjacent ribs are spaced from each other in a circumferential direction 52 relative to axis 14. In the preferred embodiment, adjacent ribs are equally spaced in circumferential direction 52. In particular the circumferential distance between two points on adjacent ribs 46 and 48 is equal to the circumferential distance between similar two points on adjacent ribs 48 and 50. Each rib is tapered radially from a base 54 to a narrower top surface 56.

In the embodiment depicted in the drawing, each clamp 10 comprises a second clamp member 58 which is attached to the first clamp member 12 by a web 60 which in this embodiment is depicted as being integral with the clamp members. In the embodiment depicted in the drawing, the clamp members and web have been fabricated from a single piece of material as, for example, by conventional molding of plastic material. Alternatively, clamp members may be fabricated individually and joined together by a separate web material. In the preferred embodiment, the clamp 10 comprises a resilient plastic material such as, for example, a polyethylene material.

Each second clamp member 58 has an axis 62 which extends in a second direction 64 which is oriented at an angle relative to the first axis 14. By way of example, the direction 64 of axis 62 is oriented at an angle of about 90° relative to the direction 16 of axis 14. In this manner, the conductor may be bent such as depicted in the drawing so that one length of the conductor connected to a connector extends in the direction 16 of axis 14 and another length of the conductor extends in the direction 64 of axis 62.

Each second clamp member 58 is removably attachable relative to a respective conductor 20, 24. With reference to the drawing, the second clamp member 58 of clamp 10 is shown in a closed mode and the second clamp member 58 of clamp 10' is shown in an open mode. In the open mode, the second clamp member 58 comprises an opening 66 and a locking segment 68 which is pivotal relative to opening 66 by virtue of being formed from a resilient material. In particular, with reference to clamp 10', locking segment 68 is pivotal relative to opening 66 for pivoting in a first pivoted direction 70 relative to axis 62 to close opening 66 (closed mode) and in an opposite pivotal direction 72 relative to axis 62 to open opening 66 (open mode).

In a preferred embodiment of the present invention as depicted in the drawing, a connector assembly is provided which comprises connector 18 and a mating connector 74 mechanically and electrically connected thereto in the conventional manner, and a connector 22 and a mating connector 76 mechanically and electrically connected thereto in the conventional manner. Connectors 18 and 22 are electrically and mechanically connected to coaxial cable-type conductors 20 and 24, respectively. Connectors 74 and 76 are electrically and mechanically connected to respective conductors (not seen) and mechanically connected to a support surface 78.

One example of the use of the present invention will now be described with reference to the embodiment depicted in the drawing in which the clamps 10, 10' are attached to respective conductors and connectors. First, a clamp 10 is attached to the conductor 20 and connector 18 as described herein such that (a) a length of each extends into cavity 42 of the first clamp member 12, and (b) a length of conductor 20 extends through a cavity 80 which extends from an end 82 to an opposite end 84 of the second clamp member 58. Second clamp member 58 may be locked in place relative to conductor 20 by mating snap members 86, 88. Then a clamp 10' is attached to conductor 24 and connector 22 in the same manner. When this step is completed, one length of each conductor 20, 24 will extend in the direction 16 of an axis 14 of a respective first clamp member 12, and a length of each conductor will extend in the director 64 of an axis 62 of a respective second clamp member 58. The axes 14 and 16 are disposed 90° relative to each other, and therefore each conductor 20, 24 has respective lengths which extend at 90° relative to each other as depicted in the drawing. The female connector 18 is then electrically and mechanically connected to the male connector 74 in the conventional manner and then rotated in circumferential direction 52 relative to axis 14 until the clamp 10 has been rotated to the desired angular position relative to axis 14; that is, until the axis 62 has in effect been rotated in the direction 52 relative to axis 14 to the extent desired. It will be apparent to those skilled in the art that such rotation of clamp 10 will also cause ribs 46, 48, 50 of clamp 10 to rotate in the direction 52 relative to axis 14. When the clamp 10 is in the desired position, the clamp 10' is oriented at a desired angular position relative to the clamp 10, and the male connector 22 is electrically and mechanically connected to the female connector 76 in the conventional manner, the ribs 46, 48, 50 of respective clamps 10, 10' mating with each other. The possible angular orientation of the clamps 10, 10' relative to each other will be limited, of course, by the requirement that ribs of clamp 10 mate or mesh with ribs of clamp 10' when the clamp 10' is connected to the connector 76. The mating of the ribs of the clamp 10 with the ribs of the clamp 10' increase resistance to relative movement of the clamps 10, 10' in the circumferential direction 52 and thereby prevent rotation of, and fix the angular orientation of, the connector 18 and conductor 20 relative to the connector 22 and conductor 24. By selecting which ribs of clamps 10, 10' mate with each other, the angular orientation of connector 18 and conductor 20 may be selectively varied as desired relative to the connector 22 and conductor 24.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention as defined by the appended claims.

What is claimed is:

1. In a connector assembly comprising a first connector and a first mating connector mechanically and electrically connected thereto, and a second connector and a second mating connector mechanically and electrically connected thereto, said first connector and said second connector being electrically and mechanically connected to a first conductor and second conductor, respectively, a first clamp and a second clamp clamped to at least one of said first conductor and said first connector, and said second conductor and said second connector, respectively, wherein the improvement comprises said first clamp and said second clamp each comprising a respective first clamp member having a first axis which extends in a first direction, each first clamp member having an outer surface and a plurality of ribs extending from said outer surface, said plurality of ribs of said first clamp member of said first clamp being adjacent to and mating with said plurality of ribs of said second clamp member of said second clamp, said first clamp member of said first clamp being attached to at least one of a first length of said first conductor, and said first connector, and said first clamp member of said second clamp being attached to at least one of a first length of said second conductor, and said second connector.

2. The connector assembly of claim 1 wherein said first clamp and said second clamp each further comprise a respective second clamp member attached to a respective first clamp member and having a second axis which extends in a second direction, said second axis being oriented at an angle relative to said first axis, said second clamp member of said first clamp and said second clamp member of said second clamp being attached to a second length of said first conductor and a second length of said second conductor, respectively.

3. The connector assembly of claim 2 wherein each rib of said plurality of ribs extends in the direction of said first axis, adjacent ribs of said plurality or ribs being spaced from each other in a circumferential direction relative to said first axis.

4. The clamp of claim 3 wherein said adjacent ribs are equally spaced in said circumferential direction.

5. The clamp of claim 3 wherein each rib of said plurality of ribs is tapered radially relative to said first axis from a base to a top surface which is narrower than said base.

6. The clamp of claim 5 wherein said outer surface comprises a first opening which extends in said first direction for the length of said first clamp member.

7. The clamp of claim 3 wherein said outer surface comprises a first opening which extends in said first direction for the length of said first clamp member.

8. The clamp of claim 7 wherein said second clamp member comprises a second opening and a locking segment which is pivotal relative to said second opening for pivoting (a) in a first pivotal direction relative to said second axis to close said second opening in a first mode and (b) in an opposite second pivotal direction relative to said second axis to open said second opening in a second mode.

9. The clamp of claim 7 wherein at least said first clamp member comprises a resilient material.

10. The clamp of claim 9 wherein said outer surface has a cylindrical configuration, and further wherein said first opening has a width which is less than the diameter of a cable to be inserted into said first clamp member.

* * * * *